US005847637A

United States Patent [19]

Takeda et al.

[11] Patent Number: 5,847,637

[45] Date of Patent: Dec. 8, 1998

[54] THERMALLY RESPONSIVE SWITCH WITH A MAGNETIC MEMBER

[75] Inventors: Hideaki Takeda; Katsuya Sakamaki, both of Misato, Japan

[73] Assignee: Uchiya Thermostat Co., Ltd., Misato, Japan

[21] Appl. No.: 702,892

[22] Filed: Aug. 26, 1996

[30] Foreign Application Priority Data

Aug. 30, 1995 [JP] Japan ..... 7-221435

[51] Int. Cl.[6] ..... H01H 37/66

[52] U.S. Cl. ..... 337/344; 337/3; 337/333; 337/342; 337/380

[58] Field of Search ..... 337/3, 15, 16, 337/35, 36, 68, 75, 85, 333, 342–344, 365, 375, 377, 380, 384; 219/505, 511, 512; 335/90, 84, 31

[56] References Cited

U.S. PATENT DOCUMENTS 4,383,231 5/1983 Yamanaka et al. ..... 337/344 X 5,550,525 8/1996 Place ..... 337/363

FOREIGN PATENT DOCUMENTS 912 275243 8/1992 China .
932 146384 2/1994 China .
93 238711 4/1994 China .
2 330246 1/1975 Germany .
4 019488 1/1992 Germany .

OTHER PUBLICATIONS

Patent Abstracts of Japan—6 119859—Jun. 26, 1994.

*Primary Examiner*—Leo P. Picard
*Assistant Examiner*—Jayprakash W. Gandhi

[57] ABSTRACT

A thermal protector includes a bimetal plate which is prevented from being vibrated by a magnetic field produced by a transformer or a motor. A member made of magnetic material is disposed in the vicinity of the bimetal plate. The fixed member for loosely holding the bimetal plate may be made of magnetic material. The fixed metal fitting for connecting a first fixed plate with a movable plate is extended near to the bimetal plate and is made of magnetic material.

7 Claims, 2 Drawing Sheets

THERMALLY RESPONSIVE SWITCH WITH A MAGNETIC MEMBER

BACKGROUND OF THE INVENTION

The present invention relates to a thermal protector, which is an electric element having electric contacts which are opened when a predetermined temperature is exceeded in order to prevent an electrical apparatus from being heated.

RELATED ART

FIG. 1 is a sectional view showing an example of a thermal protector. A first external terminal 1 connected to an external circuit is mounted at one end of a fixed plate 2 and a fixed contact 3 is disposed in the vicinity of the other end of the fixed plate 2. Similarly, a second external terminal 4 connected to the external circuit is mounted at one end of a movable plate 5 and a movable contact 6 is disposed in the vicinity of the other end of the movable plate 5. The movable plate 5 has the resilience and the movable contact 6 is urged to be pressed to the fixed contact 3 by means of the resilient force of the movable plate 5.

An insulator 7 is disposed between the fixed plate and the movable plate 5 and both of the fixed plate and the movable plate are electrically insulated from each other. A fixed member 8 made of non-magnetic synthetic resin is disposed on the movable plate 5, and a pillar-shaped portion 7*a* of the insulator 7 penetrating the movable plate 5 and the fixed member 8 fixes them together.

The fixed plate 2 is fixed by a protrusion 7*b* formed on a lower surface of the insulator 7. An end of the movable plate 5 near to the movable contact is bent into a hook to be formed into a nail 5*a*. A recess 8*a* is formed in a lower portion of the fixed member 8 near to the movable plate 5.

A bimetal plate 9 is loosely disposed between the nail 5*a* and the recess 8 and held therebetween. The bimetal plate 9 is a so-called inversion type bimetal plate, of which radius of curvature changes suddenly its sign, when its temperature exceeds a predetermined value. When the sign of the radius of curvature of the bimetal plate 9 is inverted, the bimetal plate 9 lifts the nail 5*a* of the movable plate 5 so that the movable contact 6 is separated from the fixed contact 3. Consequently, the electric circuit composed of the first external terminal, the fixed plate, the fixed contact, the movable contact, the movable plate and the second external terminal is cut off.

In order to cause the bimetal plate 9 to lift the movable plate 5 exactly, a protrusion 5*b* in the form of semisphere protruding toward the bimetal plate 9 is formed in the middle portion of the movable plate 5. The fixed plate 2, the movable plate 5, the insulator 7, the fixed member 8 and the bimetal plate 9 are assembled into a housing 10 and sealed by resin 10*a*.

Various materials for the bimetal are commercially available and almost all bimetals contain one or plural elements of Fe, Co and Ni. Accordingly, the bimetals possess a property that the bimetals are magnetized by a magnetic field.

The bimetal plate 9 is held by the nail. 5*a* and the recess 8*a* and at this time the bimetal plate 9 must be held loosely so that the sign of the radius of curvature of the shape of the bimetal plate 9 can be inverted. Accordingly, when the thermal protector is disposed in the vicinity of a motor, a transformer or the like, the bimetal plate 9 is magnetized by an alternating magnetic field generated by the motor, the transformer or the like and there is a possibility that the bimetal plate 9 vibrates.

SUMMARY OF THE INVENTION

It is an object of the present invention to provide a thermal protector having a bimetal plate which is not vibrated by a magnetic field.

The present invention is essentially characterized in that a member made of magnetic material is disposed in the vicinity of a bimetal plate in the thermal protector. In this specification, magnetic material means high magnetic permeability material having increased magnetization or ferromagnetic substance (permanent magnet) having a residual magnetization.

When there are members made of two high magnetic permeability materials in a magnetic field, the members are magnetized in accordance with the intensity of the magnetic field. And portions being in contact with each other or in close vicinity to each other are so magnetized to be attracted to each other. Accordingly, the larger the intensity of the magnetic field, the stronger the attracting force acting therebetween.

As described above, since the bimetal material contains a magnetic element, the bimetal plate can be magnetized. Accordingly, when a member made of high magnetic permeability material is disposed in the vicinity of an end of the bimetal material, the bimetal plate is magnetized by a magnetic field and the end of the bimetal plate is attracted to the member made of high magnetic permeability material, so that the bimetal plate does not vibrate.

When a member made of a permanent magnet is disposed in the vicinity of the bimetal plate, the bimetal plate is attracted to the permanent magnet. Since an alternating magnetic field generated by a motor or a transformer reduces rapidly with a distance, thus the bimetal plate does not almost vibrate.

Even if the thermal protector is disposed in a vicinity of a motor or a transformer, the bimetal plate in the thermal protector does not vibrate. As a result, it is not necessary to use a magnetic shield. Nevertheless, the thermal protector can be used together with a magnetic shield.

According to a first aspect of the present invention, the thermal protector includes a fixed plate having one end in which a first external terminal connected to an external circuit is provided and a fixed contact disposed in the vicinity of the other end of the fixed plate, a movable plate having one end in which a second external terminal connected to the external circuit is provided and a movable contact disposed in the vicinity of the other end of the movable plate, an insulator for insulating the fixed plate and the movable plate from each other, a fixed member disposed in a junction portion of the fixed plate, the insulator and the movable plate, and a bimetal plate for separating the movable contact from the fixed contact when a predetermined temperature is exceeded and which is loosely held by a nail disposed in the movable plate and the fixed member, the fixed member is made of magnetic material.

According to a second aspect of the present invention, the thermal protector includes a first fixed plate having one end in which a first external terminal connected to an external circuit is provided, a second fixed plate having one end in which a second external terminal connected to the external circuit is provided and the other end in which a fixed contact is disposed, a movable plate having a movable contact disposed in the vicinity of one end of the movable plate, a fixed metal fitting connected the first fixed plate to the movable plate so that the movable contact comes into contact with the fixed contact, and a bimetal plate for separating the movable contact from the fixed contact when a predetermined temperature is exceeded, and the fixed metal fitting is extended near to the bimetal plate and is made of magnetic material.

PREFERRED EMBODIMENTS OF THE INVENTION

Figure 1:
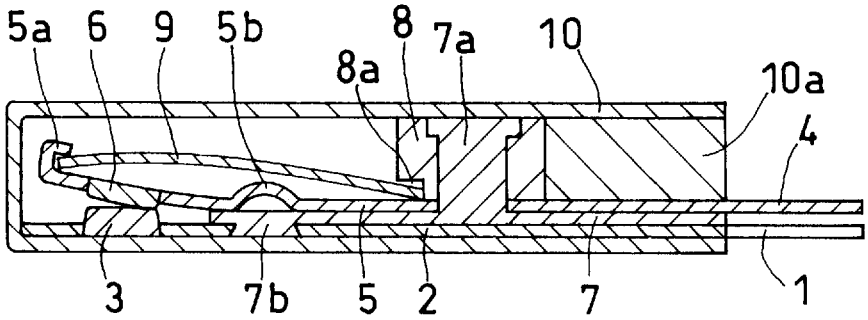
FIG. 1 is a sectional view showing an example of a thermal protector.

A structure of a first embodiment shown in FIG. 1 is identical with that of a conventional thermal protector, while material of the fixed member 8 in the embodiment is different from that in the conventional thermal protector. More particularly, the fixed member 8 in the conventional thermal protector is made of nonmagnetic synthetic resins, whereas the fixed member 8 of the present invention is made of magnetic material (for example, iron).

When the magnetic material is high magnetic permeability material and the thermal protector is disposed in an alternating magnetic field generated by a motor or a transformer, the fixed member 8 and the bimetal plate 9 are so magnetized to be attracted to each other. Consequently, a portion of the bimetal plate 9 near to the fixed member 8 is softly clamped. Accordingly, even if the thermal protector is disposed in an alternating magnetic field, the bimetal plate does not vibrate.

When the magnetic material is a permanent magnet, the bimetal plate 9 is always attracted to the fixed member 8 and similarly the portion of the bimetal plate 9 near to the fixed member 8 is softly clamped, so that even if an alternating magnetic field is generated by a motor or a transformer, the bimetal plate 9 hardly vibrates.

Figure 2:
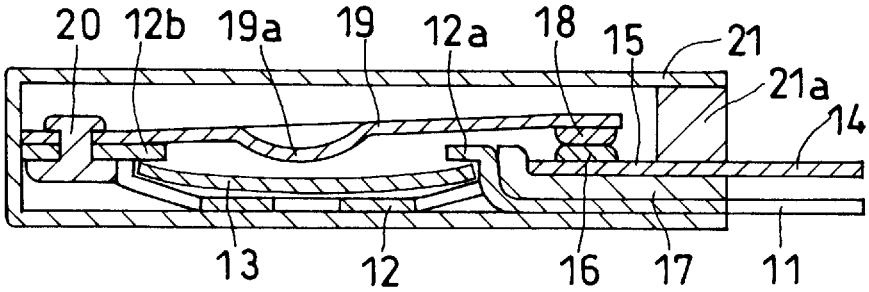
FIG. 2 is a sectional view of a thermal protector according to a second embodiment of the present invention.
Figure 3:
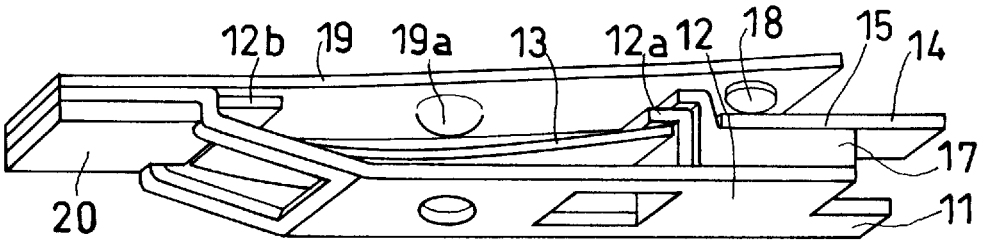
FIG. 3 is a perspective view of the thermal protector of FIG. 2.

FIG. 2 is a sectional view of a second embodiment and FIG. 3 is a perspective view of the embodiment of FIG. 2.

A first external terminal 11 connected to an external circuit is provided at one end of a first fixed plate 12 and two bimetal plate holding portions 12*a* and 12*b* are disposed in the center portion of the first fixed plate 12 so that a bimetal plate 13 is loosely held therebetween.

A second external terminal 14 connected to the external circuit is provided at one end of a second fixed plate 15 and a fixed contact 16 is disposed at the other end of the second fixed plate 15. The first and second fixed plates 12 and 15 are electrically insulated from each other by an insulator 17.

A movable contact 18 is disposed at one end of a movable plate 19 having the resilience and the movable plate 19 is fixed at the other end thereof to the first fixed plate 12 by means of a fixed metal fitting 20 so that the movable contact 18 comes into contact with the fixed contact 16.

The bimetal plate 13 is an inversion type bimetal plate having a sign of a radius of curvature which is inverted when a predetermined temperature is exceeded, and when it is inverted, the movable contact 18 is separated from the fixed contact 16. Consequently, the electric circuit composed of the first external terminal 11, the first fixed plate 12, the movable plate 19, the movable contact 18, the fixed contact 16, the second fixed plate 15 and the second external terminal 14 is cut off. In order to lift the movable contact 18 exactly, a semispheric protrusion 19*a* is formed in the center portion of the movable plate 19 opposite to the bimetal plate 13.

In this embodiment, the fixed metal fitting 20 is made of magnetic material and is extended near to the bimetal plate 13.

When the magnetic material is high magnetic permeability material, the bimetal plate 13 and the fixed metal fitting 20 are attracted to each other by an alternating magnetic field generated by a motor or a transformer so that the bimetal plate 13 is softly clamped and is not vibrated by the alternating magnetic field.

When the magnetic material is a permanent magnet, the bimetal plate 13 is always attracted to the fixed metal fitting 20 so that the bimetal plate 13 is clamped similarly and even if there is an alternating magnetic field, the bimetal plate 13 is not almost vibrated.

The assembly including the first and second fixed plates 11 and 14, the bimetal plate 13, the movable plate 19, the insulator 17 and the fixed metal fitting 20 is inserted into a housing 21 and sealed by resin 21*a*.

Figure 4:
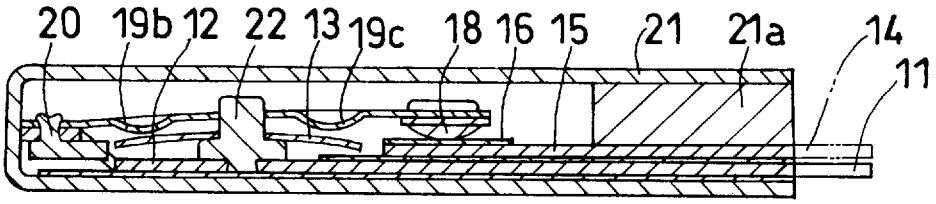
FIG. 4 is a sectional view of a thermal protector according to a third embodiment of the present invention.
Figure 5:
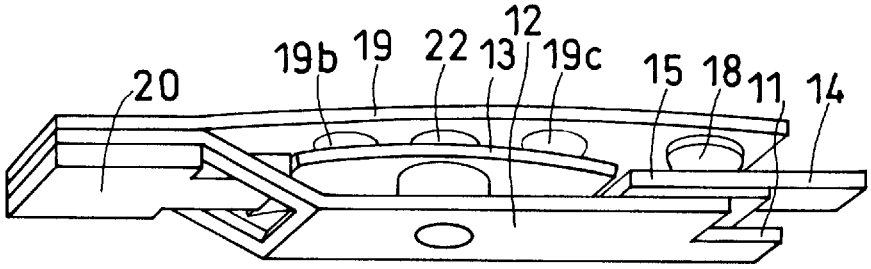
FIG. 5 is a perspective view of the thermal protector of FIG. 4.

FIG. 4 is a sectional view of a third embodiment of the present invention and FIG. 5 is a perspective view of the embodiment of FIG. 4.

The third embodiment is a modification of the second embodiment. Accordingly, like members are designated by the same reference numerals and description thereof is omitted.

In the third embodiment, holes are formed in the center portions of the bimetal plate 13 and the movable plate 19. A pillar-shaped member 22 made of electrically insulative material is loosely penetrated through the holes and the bimetal plate 13 is placed on a flange portion of the pillar-shaped member 22.

When a predetermined temperature is exceeded, the radius of curvature of the shape of the bimetal plate 13 is reversed and the bimetal plate 13 pushes up the movable plate 19, so that the movable contact 18 is separated from the fixed contact 16. In order to ensure this operation, the movable plate 19 is provided with semispheric protrusions 19*b* and 29*c* disposed on both sides of the pillar-shaped member 22.

Similarly to the second embodiment, the fixed metal fitting 20 is made of magnetic material and is extended near to the bimetal plate 13. Even if the thermal protector is disposed in an alternating magnetic field generated by a motor or a transformer, the bimetal plate is not vibrated.

We claim:

1. A thermal protector comprising:

a fixed plate having one end in which a first external terminal connected to an external circuit is disposed and a fixed contact disposed in the vicinity of the other end thereof, a movable plate having one end in which a second external terminal connected to the external circuit is disposed and a movable contact disposed in the vicinity of the other end thereof, a bimetal plate for separating said movable contact from said fixed contact when a predetermined temperature is exceeded, and a member made of magnetic material disposed in the vicinity of said bimetal plate.

2. A thermal protector according to claim 1, wherein the bimetal plate is loosely supported at one end by the magnetic member and at another end by an end portion of the fixed plate.

3. A thermal protector according to claim 1, wherein the bimetal plate is an inversion type metal plate.

4. The thermal protector according to claim 1, wherein the member made of magnetic material is electrically operative to magnetize the bimetal plate so that the bimetal plate will not vibrate.

5. A thermal protector comprising:

a fixed plate having one end in which a first external terminal connected to an external circuit is disposed and a fixed contact disposed in the vicinity of the other end thereof, a movable plate having one end in which a second external terminal connected to the external circuit is disposed and a movable contact disposed in the vicinity of the other end thereof, an insulator for insulating said fixed plate and said movable plate from each other, a fixed member disposed in a junction portion of said fixed plate, said insulator and said movable plate, and a bimetal plate for separating said movable contact from said fixed contact when a predetermined temperature is exceeded and which is loosely held by a nail provided in said movable plate and said fixed member, said fixed member being made of magnetic material.

6. A thermal protector according to claim 5, further comprising:

a pillar-shaped member penetrating through holes formed in the center portions of said bimetal plate and said movable plate, said bimetal plate being held by a flange portion of said pillar-shaped member.

7. A thermal protector comprising a first fixed plate having one end in which a first external terminal connected to an external circuit is disposed, a second fixed plate having one end in which a second external terminal connected to the external circuit is disposed and the other end in which a fixed contact is disposed, a movable plate including a movable contact disposed in the vicinity of one end thereof, a fixed metal fitting for connecting said first fixed plate with said movable plate so that said movable contact comes into contact with said fixed contact, and a bimetal plate for separating said movable contact from said fixed contact when a predetermined temperature is exceeded, said fixed metal fitting being extended near to said bimetal plate and made of magnetic material.

* * * * *